United States Patent [19]

Hartley et al.

[11] Patent Number: 4,645,426

[45] Date of Patent: Feb. 24, 1987

[54] BILGE PUMP

[76] Inventors: E. Dale Hartley, 1706 Decker Rd., Malibu, Calif. 90265; F. Scott Hartley, 60 Mansfield Ln., Camarillo, Calif. 93010

[21] Appl. No.: 726,636

[22] Filed: Apr. 24, 1985

[51] Int. Cl.[4] ..... F04B 49/04

[52] U.S. Cl. ..... 417/38; 417/44

[58] Field of Search ..... 417/38, 44

[56] References Cited

U.S. PATENT DOCUMENTS

| | | | |
|---|---|---|---|
| 2,488,506 | 11/1949 | Bernhardt | 417/38 |
| 2,765,743 | 10/1956 | Hollinshead | 417/44 |
| 2,804,516 | 8/1957 | Staak | 417/38 |
| 3,043,225 | 7/1962 | Nielsen | 417/44 |
| 3,318,249 | 5/1967 | Loeser | 417/38 |
| 3,717,421 | 2/1973 | Schaefer | 417/38 |

FOREIGN PATENT DOCUMENTS

| | | | |
|---|---|---|---|
| 2926502 | 1/1981 | Fed. Rep. of Germany | 417/38 |

*Primary Examiner*—Carlton R. Croyle
*Assistant Examiner*—Theodore L. Olde
*Attorney, Agent, or Firm*—Gordon L. Peterson

[57] ABSTRACT

A pump operable in response to the level of the liquid to be pumped comprising an impeller, a motor for rotating the impeller, a discharge passage for receiving the liquid pumped by the impeller, and a sensing chamber communicating with the discharge passage between the impeller and the pump outlet so that liquid in the discharge passage can trap gas in the sensing chamber. A pump controller is responsive to the pressure of the trapped gas in the sensing chamber for energizing and di-energizing the motor. Energizing of the motor to cause the impeller to pump liquid into the discharge passage substantially increases the pressure of the trapped gas to thereby assure that the pump remains on.

15 Claims, 3 Drawing Figures

BILGE PUMP

BACKGROUND OF THE INVENTION

Many pumps operate intermittently in response to the level of the liquid being pumped. Examples of these pumps are bilge pumps and basement pumps.

Pumps of this type are commonly controlled by a float-type level controller which may actuate a mercury switch in response to the level of the liquid to start and stop the pump. These pump controllers require conductors from the switch to the pump motor, and the switch and conductors must function in an environment which may include a corrosive liquid, such as salt water and/or other contaminants of the type found in bilges, flooded basements, etc. The orientation of the switch controls the on-off action, and this is a disadvantage in marine applications in which the boat undergoes pitching or rolling movement.

It is also known to use a liquid level sensor which uses the pressure of a gas in a sensing chamber to determine liquid level. For example, as shown in Staak U.S. Pat. No. 2,804,516, a sensing chamber which is open to the liquid can be employed so that a gas, such as air, is compressed in the sensing chamber by the liquid. Thus, the pressure of the gas rises and falls, respectively, with rising and falling liquid levels, and this can be used to control operation of the pump.

One problem with using a sensing chamber to control the pump is in obtaining pump shut off when the liquid level drops to the desired shut-off level. More specifically, we have found that the column of water or air and water in the standpipe on the pump discharge provides sufficient pressure in the sensing chamber to preclude prompt pump shut off. In this regard, the rotating impeller of the pump serves as a valve to prevent the liquid in the standpipe from emptying by gravity back into the sump, and the pressure sensed by the sensing chamber is the full pump discharge pressure because it communicates directly with the periphery of the impeller where the pump discharge pressure is maximum. Although the pump will eventually shut off after a period of sputtering output, the pump runs unnecessarily long after essentially all of the liquid has been evacuated.

SUMMARY OF THE INVENTION

This invention solves this problem by causing the sensing chamber to sense a pressure which is a function of pump discharge pressure but which is less than the pump discharge pressure at the periphery of the impeller. The pressure sensed is insufficient to cause the pump to continue to run when essentially all the liquid is exhausted, except liquid or liquid and air in the standpipe. Accordingly, sputtering pump output is essentially eliminated and more prompt shut off occurs.

This can be simply obtained at low cost by providing a fluid path from the liquid being pumped radially inwardly of the impeller's periphery and the sensing chamber without passing around the impeller's periphery so that the pressure sensed by the sensing chamber is less than the pressure at the periphery of the impeller. Thus, the fluid path is a path to the lower pressures which exist radially inwardly of the impeller's periphery. Consequently, the sensing chamber senses lower pressures than it would without such fluid path, and the pump can be shut off when it would otherwise provide a sputtering output.

The fluid path from a radial inward region of the impeller and the sensing chamber can be provided in different ways. In a preferred construction, the impeller has a transverse wall and a plurality of vanes, and the fluid path includes an opening extending through the transverse wall to the interior of the impeller. Alternatively or in addition thereto, a passage may be provided in the shaft or other means that mounts the impeller for rotation.

In a preferred construction, the impeller is mounted for rotation in a housing with the transverse wall of the impeller confronting an interior wall of the housing and being spaced therefrom by a gap. The opening in the transverse wall of the impeller leads into the gap.

With the above-described construction, the sensing chamber can communicate with the gap through a port in the interior wall. The port lies at least partially between the rotational axis of the impeller and the periphery of the impeller. Thus, the port is at a pressure intermediate zero-gauge pressure which exists theoretically at the center of rotation of the impeller and the maximum positive pressure which exists at the impeller periphery, i.e., the outer tip of the impeller vanes.

The position of the port radially of the impeller can be varied depending upon the type of shut-off conditions desired. For example, as the port is moved closer to the center of rotation of the impeller, shut-off will occur sooner, but less pressure is available in the sensing chamber for operating a pressure switch or other control member which cycles the pump motor on and off. Generally, the port should be at least partially radially inwardly of the impeller periphery, and preferably, it lies entirely radially inwardly of the impeller periphery. It is also preferred to have the port lie radially outwardly of the opening in the transverse wall of the impeller. For manufacturing convenience, the opening is preferably in the transverse wall, rather than in the shaft which mounts the impeller for rotation.

This invention uses control means which is responsive to the pressure of the gas in the sensing chamber reaching a predetermined magnitude for causing the motor to drive the impeller and responsive to the pressure in the sensing chamber dropping to a second predetermined magnitude, to terminate the driving of the impeller by the motor. The second predetermined magnitude may be greater, less than, or equal to, the first predetermined magnitude, depending upon the results desired. Although the starting and stopping of the impeller could be brought about in different ways, preferably, this is accomplished by energizing and de-energizing the motor, respectively, to thereby avoid unnecessary operation of the motor and consequent reduction in the life of the motor.

The means which defines the sensing chamber preferably includes a diaphragm movable in response to the pressure of the trapped gas in the sensing chamber, and the control means is responsive to such movement of the diaphragm to cycle the pump motor on and off. It is sometimes necessary or desirable to manually operate the pump, and with this invention, manual means is provided for moving the diaphragm to operate the control means. Although this can be accomplished in different ways, in a preferred embodiment, the manual means includes an actuator carried by the diaphragm and means responsive to certain movement of the actuator for pivoting the actuator to complete a circuit to energize the motor.

The control means includes a switch on the side of the diaphragm opposite the sensing chamber for use in operating the motor means. It is necessary to supply power to the switch and to the motor, and because the motor must operate in a wet environment, the conductors are run to the pump housing through a tube or conduit which is adapted to exclude water. This tube extends well above the highest liquid level that would be anticipated. Another feature of this invention is the use of that tube as a vent passage for venting the side of the diaphragm opposite the sensing chamber. This improves the accuracy of motor control in that it is not necessary to compress air in order to move the diaphragm to operate the switch for the motor.

The invention, together with additional features and advantages thereof, may best be understood by reference to the following description taken in connection with the accompanying illustrative drawings.

DESCRIPTION OF THE PREFERRED EMBODIMENT

Figure 1:
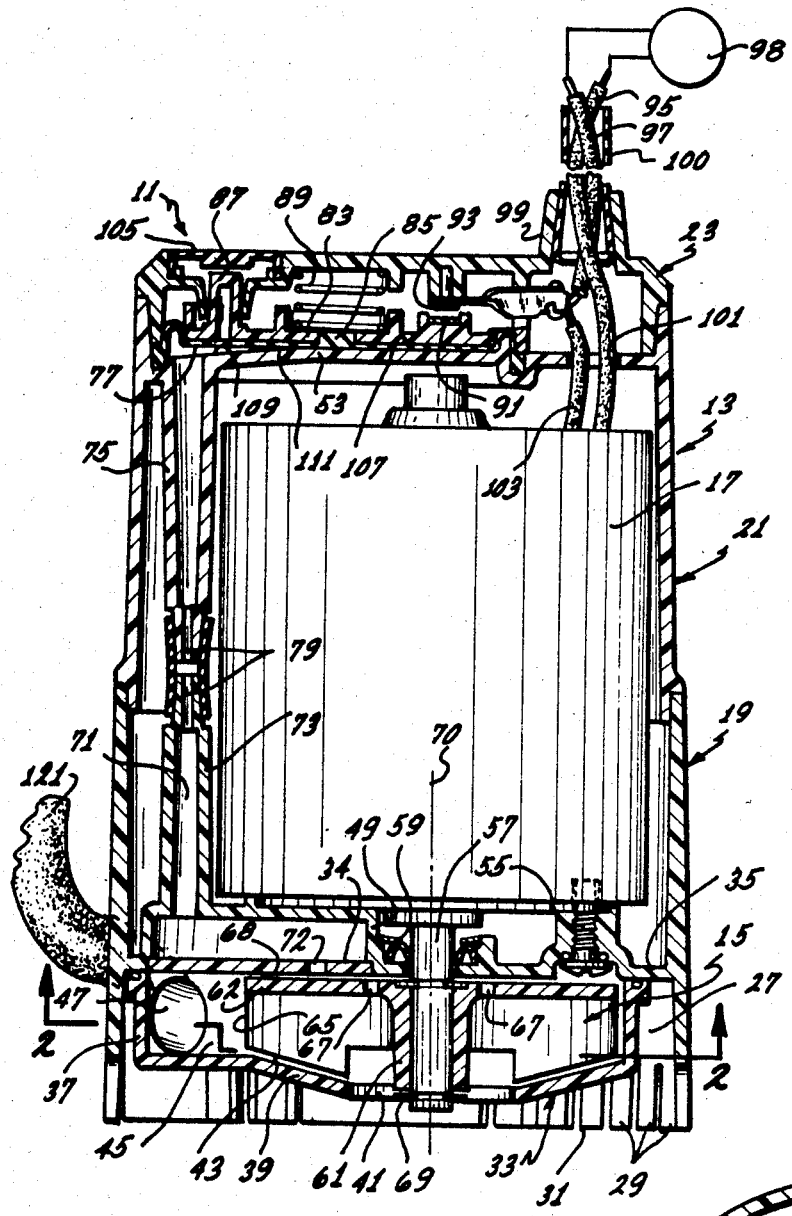
FIG. 1 is an axial sectional view of a pump constructed in accordance with the teachings of this invention.

The drawings show a bilge pump 11 which includes a housing 13, a pumping member in the form of an impeller 15 and a motor 17 for driving the impeller. The housing 13, in the embodiment illustrated, includes a lower housing section 19, an upper housing section 21, and a cover or cover section 23 suitably joined together. The housing sections 19 and 21 and the cover 23 are preferably molded from a suitable plastic material. The housing sections 19 and 21 are tubular and coaxial and are held together in sealed end-to-end relationship.

The lower housing section 19 terminates downwardly in a skirt 27 which has slots 29 and which surrounds a large downwardly facing opening 31. The slots 29 serve as a filter for liquid passing into the interior of the skirt 27. The lower housing section 19 has a pair of mounting lugs 32 for mounting the pump 11 on external structure (not shown).

A bottom plate or cup-shaped member 33 is received in the skirt 27 and cooperates with a lower wall 35 of the lower housing section 19 and a sensing plate or interior wall 34 to define an impeller chamber. The cup-shaped member 33, which is preferably integrally molded from a suitable plastic material, is attached to the lower housing section 19 in any suitable manner, such as by a plurality of screws (not shown). The cup-shaped member 33 has a peripheral wall 37 and an end wall 39 with a circular opening which defines an inlet 41 leading axially to the impeller 15. The end wall 39 and the wall 35 define a flow passage 43 which leads from the inlet 41 through the impeller 15 and a discharge passage 45 to an outlet 47. The discharge passage 45 may be considered as extending downstream of the outlet 47 and as including a standpipe or hose 121.

As shown in FIG. 1, the lower wall 35 has a cup portion 49 which opens downwardly. The interior wall 34 is sealingly attached to the cup portion 49 and may be considered as forming a portion of the lower housing section 19.

The motor 17 is mounted in a sealed cavity between the wall 35 of the lower housing section 19 and an upper end wall 53 of the upper housing section 21 in any suitable manner, such as by a plurality of screws 55. The motor 17 has a drive shaft 57 which projects through an opening in the wall 35 and a seal 59 prevents entry of liquid into the motor cavity through the opening in the wall 35.

The impeller 15 is preferably integrally molded from a suitable plastic material and it includes a hub 61, a transverse wall 62, and a plurality of curved vanes 63 integral with the wall 62 and the hub and extending radially outwardly of the hub. The impeller 15 has a periphery 65 which is defined by the outer ends of the vanes 63 and an opening in the form of four separate openings 67 in the transverse wall. The hub 61 has a central bore, and the bore and the shaft 57 have cooperating flat surfaces 66. The shaft 57 is received into the bore of the hub 61, and the impeller 15 is held on the shaft by a retainer 69, with the transverse wall 62 being spaced from the walls 34 and 35 by a gap 68. With this construction, the impeller 15 is driven about a vertical rotational axis 70 and pumps fluid from the inlet 41 through the discharge passage 45 to the outlet 47.

The openings 67 extend from the flow passage 43 in the interior of the impeller 15 to the gap 68. In this embodiment, the openings 67 are equally spaced from the rotational axis 70.

Figure 2:
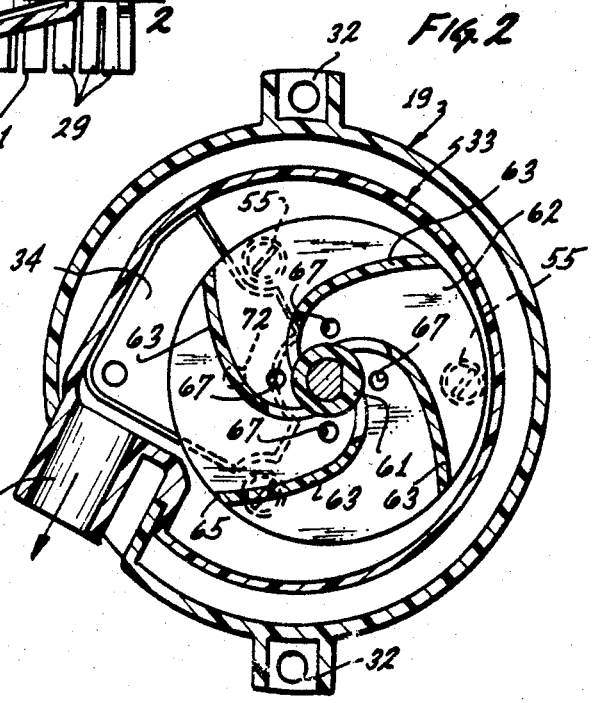
FIG. 2 is a sectional view taken generally along line 2—2 of FIG. 1.

A sensing chamber 71 in the form of a vertical column opens into the discharge passage 45 through an enlarged portion of the chamber (FIGS. 1 and 2) at a port 72 in the sensing plate 34. The port 72 is at a location intermediate the periphery 65 of the impeller 15 and the rotational axis 70, and it leads to the gap 68. Preferably, the port 72 lies radially outwardly of the openings 67. Although the sensing chamber 71 may be outside the housing 13, in the embodiment illustrated, the sensing chamber 71 is defined by tubes 73 and 75 of the lower housing section 19 and the upper housing section 21, respectively, the end wall 53 and a diaphragm 77 coupled to the end wall 53 just above the upper end of the tube 75. The tubes 73 and 75 are coaxial with respect to each other, and each of the tubes 73 and 75 has a restricted orifice 79 at their confronting ends. The tubes 73 and 75 are sealed together by a seal 81, and except for the opening 72, the sensing chamber 71 is air tight. This construction permits a column of air to be trapped in the upper end of the sensing chamber 71 as the liquid level rises.

Figure 3:
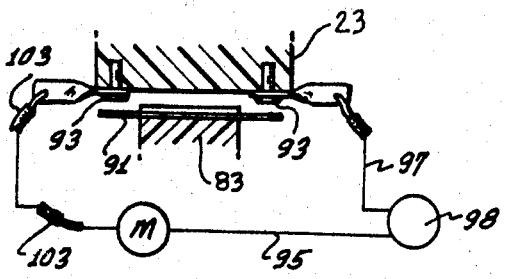
FIG. 3 is a fragmentary, somewhat schematic view illustrating one way in which the motor can be wired.

An actuator 83 in the form of a circular plate is mounted on the diaphragm 77 by a knob 85 of the diaphragm which projects through a central region of the actuator 83. The actuator 83, which is preferably molded of a rigid plastic material has an upstanding button 87 and a spring 89. A contact plate 91 is mounted on the actuator 83 and is engageable with confronting contacts 93 (FIG. 3) mounted on the cover 23. Conductive leads 95 and 97 extend from a source 98 of electrical power well above the pump 11 through a tube or conduit 100 (FIG. 1) and a boss 99 in the cover 23 to the motor 17 and to one of the contacts 93, respectively. The upper end of the tube 100 is open to the atmosphere above the fluid environment in which the pump 11 operates so the tube can vent the housing above the diaphragm and also serve as a conduit for the leads 95 and 97. The lead 95 also extends through an opening 101 in the end wall 53. Another lead 103 extends from the other contact 93 through the opening 101 to the motor 17. The cover 23 has a small resilient diaphragm 105 immediately above the button 87. The end wall 53 has a diaphragm supporting surface 107 and a ramp surface 109 which is inclined with respect to the surface 107. In the de-energized condition as shown in FIG. 1, the spring 89 holds a portion of the diaphragm against the diaphragm supporting surface 107, and at least some of the ramp surface 109 is uncovered by the diaphragm 77 and exposed within the sensing chamber 71.

In use, the pump 11 is mounted in a bilge, basement or other area containing a liquid to be pumped, with the inlet 41 opening downwardly and preferably with the rotational axis of the impeller 15 extending vertically. Assuming that the motor 17 is de-energized and that the water level is below the inlet 41, then as the water level rises, it enters the inlet and passes through passage means provided by the impeller 15 and the discharge passage 45 to the outlet 47. In use, the outlet 47 is coupled to the discharge hose or standpipe 121 which extends upwardly, such as out of the basement or bilge to a location where the liquid can be pumped. As the liquid level rises, it enters the bottom portion of the sensing chamber 71 to trap air in the upper portion of the sensing chamber. As the liquid level continues to rise, the air in the sensing chamber 71 compresses and acts over the full area of the diaphragm 77 in that the diaphragm is not sealed against the surface 107.

As the air compresses in the sensing chamber 71, it forces the diaphragm 77 progressively upwardly against the biasing action of the spring 89. Because the region above the diaphragm 77 is vented by the tube 100, upward movement of the diaphragm can occur without compressing air. Ultimately, this brings the contact plate 91 into engagement with the contacts 93 to complete a circuit from the power source 98 to the motor 17. This energizes the motor 17 to rotate the impeller 15 to cause liquid to be pumped from the inlet 41 through the discharge passage 45 to the outlet 47. The pumping of liquid in this manner rapidly and substantially increases the pressure at the location where the sensing chamber 71 communicates with the discharge passage 45. Consequently, the trapped air in the sensing chamber 71 is compressed to a much greater degree, thereby strongly holding the diaphragm 77 upwardly with the contact plate 91 in engagement with the contacts 93. For example, the pump 11 may be started in response to an air pressure of about two inches of water in the sensing chamber 71, and the pump may provide a pressure of the order of 5 psig. Consequently, inadvertent shut-off of the motor 17 or unstable operation due to weak contact between the contact plate 91 and the contacts 93 will not occur.

The impeller 15 maintains a relatively high discharge pressure in the discharge passage 45 so long as there is water available to be pumped. However, as the water level drops below the impeller 15, the pump begins pumping air. As an air compressor, the impeller 15 can produce only an extremely small positive pressure in the discharge passage 45 and significantly less than the pressure required to hold the contact plate 91 in engagement with the contacts 93. Accordingly, as soon as the impeller 15 begins pumping air, in lieu of water, the pressure in the sensing chamber 71 drops sufficiently to allow the spring 89 to move the diaphragm 77 downwardly to separate the contact plate 91 from the contacts 93 thereby de-energizing the motor 17. Accordingly, the pump 11 cannot run after the liquid has dropped below a level where it can be pumped. The prompt shut-off of the motor 17 is the result of the fluid path provided by the openings 67, the gap 68 and the port 72. More specifically, this fluid path provides communication between the liquid being pumped by the impeller 15 at a radial, inward location of the impeller and the sensing chamber 71. If this fluid path were not provided, the sensing chamber 71 would "see" only the relatively higher liquid pressure that exists at the periphery 65 of the impeller 15. With the standpipe 121 retaining a significant volume of water, the pressure "seen" by the sensing chamber 71 would be relatively high if the openings 67 were not provided, and a period of sputtering output could be expected before the pump shut off. However, the openings 67 and the positioning of the port 72 radially inwardly of the periphery 65 of the impeller 15 enable the sensing chamber 71 to "see" the much lower pressure which exists nearer the rotational axis 70. This pressure is essentially the pressure that the impeller can generate as an air compressor when essentially all of the water has been forced into the standpipe 121. Consequently, the motor 17 is promptly shut off, even though the standpipe 121 may contain substantial quantities of water.

The motor 17 can be energized manually as may be required for testing or, if it is desired to begin pumping before the liquid level has risen to the preset level. In either event, this can be accomplished by pushing the diaphragm 105 downwardly against the button 97 to push a region of the actuator 83 downwardly toward the ramp surface 109. This causes the actuator 83 to pivot about a pivot axis 111 at the juncture of the surface 107 and 109 to pivot the contact plate 91 upwardly into engagement with the contacts 93. The motor 17 can be de-energized by a manual switch (not shown) if it is desired to terminate pumping action before the pump runs out of water to pump.

Although an exemplary embodiment of the invention has been shown and described, many changes, modifications and substitutions may be made by one having ordinary skill in the art without necessarily departing from the spirit and scope of this invention.

We claim:

1. A pump having an inlet and operable in response to the level of liquid to be pumped wherein said level is variable, said pump comprising:

an impeller for pumping liquid, said impeller having a periphery and an inlet which is positionable to receive the liquid;

means for driving the impeller to cause the impeller to pump the liquid and to provide the liquid under pressure;

passage means for receiving the liquid under pressure from the impeller;

means for permitting the liquid to pass from the inlet side of the pump into the passage means when the impeller is not being driven by the driving means whereby the passage means receives liquid as the liquid level rises and also receives the liquid under pressure from the impeller;

means defining a sensing chamber which is open to the liquid at a location where it can receive the liquid under pressure from the impeller and where it can receive the liquid which passes into the passage means when the impeller is not being driven whereby gas in the sensing chamber can be compressed and the pressure of the gas increases with an increase in height of the level of the liquid;

said location being at least partially radially inwardly of said periphery;

means for providing a fluid path from the liquid being pumped radially inwardly of the periphery of the impeller to said location without passing around said periphery whereby the pressure sensed by the sensing chamber is less than the pressure at said periphery;

control means responsive to the pressure of the gas in the sensing chamber reaching about a first magnitude for causing said driving means to drive said impeller to pump the liquid into the passage means and responsive to the pressure in the sensing chamber dropping to a second magnitude to terminate the driving of the impeller by the driving means; and the pumping of liquid by the impeller elevating the pressure of the gas in the sensing chamber to a magnitude which is above said first magnitude.

2. A pump as defined in claim 1 wherein said second magnitude is above the pressure level the impeller can generate in said sensing chamber as an air compressor and the control means shuts off the motor means in response to the pressure of said trapped gas being at said second magnitude whereby the motor means is shut off approximately when the liquid level drops sufficiently so that liquid is not being pumped by the impeller.

3. A pump as defined in claim 1 wherein said sensing chamber defining means includes a movable diaphragm movable in response to the pressure of the gas in the sensing chamber, said control means is responsive to the movement of the diaphragm, and said pump includes manual means for moving the diaphragm to operate the sensing means and thereby manually control the driving member.

4. A pump as defined in claim 3 wherein said manual means includes an actuator carried by said diaphragm and means for mounting the actuator for pivotal movement.

5. A pump as defined in claim 1 wherein said fluid path extends through the impeller radially inwardly of the periphery thereof.

6. A pump as defined in claim 1 wherein said sensing chamber defining means includes a movable diaphragm movable in response to the pressure of the gas in the sensing chamber, said control means is responsive to the movement of the diaphragm, one side of said diaphragm communicates with said sensing chamber, said control means includes a switch on the other side of the diaphragm for use in operating said driving means, a tube communicating with said other side of the diaphragm for venting said other side of the diaphragm, and at least one conductor coupled to said switch and extending through the tube.

7. A pump operable in response to the level of liquid to be pumped wherein said level is variable, said pump comprising:

a housing having an interior wall and a flow passage on one side of the interior wall which extends through the housing from an inlet to an outlet;

an impeller in said flow passage, said impeller having a transverse wall, a plurality of vanes and a periphery;

means for mounting said impeller for rotation with the transverse wall confronting the interior wall and being spaced therefrom by a gap and with the impeller being at least partially in said flow passage, at least one of the mounting means and the transverse wall having an opening therein extending between the interior of the impeller and the gap;

motor means for rotating said impeller about a rotational axis, said impeller permitting the liquid to pass through it in flowing from the inlet to the outlet even when the impeller is not being driven by the motor means;

means defining a sensing chamber in said housing, said sensing chamber communicating with the impeller through a port in said interior wall so that the sensing chamber can receive liquid pumped by the impeller through the opening and the port whereby liquid at said location can trap gas in the sensing chamber;

said port lying at least partially between said rotational axis and the periphery of the impeller;

control means responsive to the pressure of the trapped gas in the sensing chamber reaching a first predetermined magnitude for energizing said motor means for driving said impeller to pump the liquid through the outlet and responsive to the pressure in the sensing chamber dropping to a second predetermined magnitude to de-energize the motor means; and the pumping of liquid by the impeller elevating the pressure of the trapped gas in the sensing chamber to a magnitude above said first predetermined magnitude.

8. A pump as defined in claim 7 wherein said second predetermined magnitude is a pressure which causes the motor means to be de-energized by the control means when the impeller is not pumping the liquid.

9. A pump as defined in claim 7 wherein said-sensing chamber defining means includes a movable diaphragm in said housing which is movable in response to the pressure of the trapped gas in the sensing chamber, said control means being responsive to movement of the diaphragm.

10. A pump as defined in claim 9 wherein the control means includes an actuator carried by said diaphragm, at least one region of said actuator being manually movable, means within said housing for causing said actuator to pivot in response to said movement of said one region of the actuator, and said control means includes means responsive to such pivotal movement of the actuator for energizing the motor means whereby the motor means can be manually started.

11. A pump as defined in claim 7 wherein the port lies radially outwardly of said opening.

12. A pump as defined in claim 7 wherein the opening is in said transverse wall.

13. A pump as defined in claim 12 wherein the port lies radially outwardly of said opening.

14. A pump as defined in claim 10 wherein one side of said diaphragm communicates with said sensing chamber, said control means includes a switch on the other side of the diaphragm for use in operating said motor means, a tube communicating with said other side of the diaphragm for venting said other side of the diaphragm, and at least one conductor coupled to said switch and extending through the tube.

15. A pump as defined in claim 1 wherein said sensing chamber is enlarged substantially at said location.

* * * * *